US010316527B2

(12) United States Patent
Keene

(10) Patent No.: US 10,316,527 B2
(45) Date of Patent: Jun. 11, 2019

(54) UNCOUPLING MAT

(71) Applicant: Keene Building Products Co., Inc., Mayfield Heights, OH (US)

(72) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 0 days.

(21) Appl. No.: 15/517,359

(22) PCT Filed: Oct. 15, 2015

(86) PCT No.: PCT/US2015/055729

§ 371 (c)(1),
(2) Date: Apr. 6, 2017

(87) PCT Pub. No.: WO2016/061346

PCT Pub. Date: Apr. 21, 2016

(65) Prior Publication Data

US 2017/0298637 A1 Oct. 19, 2017

Related U.S. Application Data

(60) Provisional application No. 62/064,075, filed on Oct. 15, 2014.

(51) Int. Cl.

| | |
|---|---|
| ***E04F 15/02*** | (2006.01) |
| ***E04F 15/18*** | (2006.01) |
| ***E04F 15/20*** | (2006.01) |
| ***E04F 15/22*** | (2006.01) |

(52) U.S. Cl.
CPC ..... *E04F 15/0215* (2013.01); *E04F 15/182* (2013.01); *E04F 15/186* (2013.01); *E04F 15/203* (2013.01); *E04F 15/22* (2013.01)

(58) Field of Classification Search
CPC ... E04F 15/0215; E04F 15/182; E04F 15/186; E04F 15/203; E04F 15/18
See application file for complete search history.

(56) References Cited

U.S. PATENT DOCUMENTS 6,167,668 B1 1/2001 Fine et al.
8,590,670 B1 * 11/2013 Grube ..... E04F 15/203 181/286
8,647,734 B2 2/2014 Keene
(Continued)

OTHER PUBLICATIONS

International Search Report and Written Opinion for corresponding International Application No. PCT/US2015/055729 dated Dec. 22, 2015.

(Continued)

*Primary Examiner* — Brian D Mattei
(74) *Attorney, Agent, or Firm* — Renner, Otto, Boisselle & Sklar, LLP

(57) ABSTRACT

An uncoupling mat includes an uncoupling layer; a layer of adhesive underlying the uncoupling layer, the adhesive layer having a subfloor-bonding surface; and an entangled filament sheet overlying the uncoupling layer, the entangled filament sheet being a resilient three-dimensional web of extruded polymer monofilaments, the polymer monofilaments being heat welded at junctions to form an open network of tangled monofilament.

14 Claims, 3 Drawing Sheets

(56) References Cited

U.S. PATENT DOCUMENTS

2006/0217017 A1* 9/2006 Tavy ..... E04F 13/04 442/59
2006/0230699 A1* 10/2006 Keene ..... E04F 15/20 52/480
2006/0260233 A1* 11/2006 Schluter ..... E04F 15/08 52/302.3
2007/0066176 A1* 3/2007 Wenstrup ..... B32B 5/022 442/415
2008/0236943 A1* 10/2008 Zickell ..... E04B 1/8409 181/294
2009/0242325 A1* 10/2009 Dellinger ..... E04F 1/84 181/290
2010/0077684 A1* 4/2010 Socha ..... E04F 15/20 52/403.1
2010/0196658 A1* 8/2010 Weller ..... E04F 13/142 428/134
2010/0229486 A1* 9/2010 Keene ..... E04F 15/20 52/403.1
2010/0282539 A1* 11/2010 Cais ..... B32B 5/26 181/290
2011/0107700 A1* 5/2011 Keene ..... B32B 5/12 52/403.1
2012/0183746 A1* 7/2012 Keene ..... B32B 3/06 428/193
2013/0167463 A1* 7/2013 Duve ..... E04F 13/21 52/390
2014/0190616 A1* 7/2014 Archbold ..... C09J 7/0289 156/71
2014/0202626 A1* 7/2014 Sennik ..... E04F 15/0215 156/249
2015/0021315 A1* 1/2015 Blanke ..... F24D 13/024 219/553
2016/0053497 A1* 2/2016 Chang ..... B32B 5/022 428/41.8
2017/0136731 A1* 5/2017 Rose ..... B32B 5/022
2017/0284108 A1* 10/2017 Larson ..... E04F 15/185

OTHER PUBLICATIONS

Reply to International Search Report and Written Opinion for corresponding International Application No. PCT/US2015/055729 dated Aug. 8, 2016.
International Preliminary Report on Patentability for corresponding International Application No. PCT/US2015/055729 dated Dec. 2, 2016.

* cited by examiner

UNCOUPLING MAT

This application is a national phase of International Application No. PCT/US2015/055729 filed Oct. 15, 2015 and published in the English language, which claims priority to U.S. Provisional Application No. 62/064,075 filed Oct. 15, 2014.

TECHNICAL FIELD

The present invention relates to an uncoupling mat, and in particular, to a self-adhesive uncoupling mat for reducing crack transmission in flooring installations.

BACKGROUND

An uncoupling mat is commonly used in building construction to bridge cracks in a concrete subfloor or to create a reinforced underlayment on a wood subfloor without the need of cementitious backer board. Installation of an uncoupling mat allows a contractor to safely build up a highly flexible subfloor or a highly crack prone floor with the same product.

An uncoupling material is typically composed of a bottom fabric or fleece layer and an upper layer of plastic configured to receive a mortar bed and to key in the mortar. In the application of the uncoupling mat, the fabric or fleece bottom layer of the mat is adhered to the subfloor. Tiles may be installed by bonding to the top plastic surface of the mat with mortar. Should a large shift or movement in the subfloor occur, the plastic layer "uncouples" from the fabric while maintaining the mortar bed intact.

The typical application involves using a first layer of mortar adhesive, or thin set, to bond the bottom of the fabric layer to the subfloor. This time consuming installation is typically accomplished with a latex modified cementitious mortar.

SUMMARY

In one aspect of the invention there is provided an uncoupling mat that includes an uncoupling layer; a layer of adhesive underlying the uncoupling layer, the adhesive layer having a subfloor-bonding surface; and an entangled filament sheet overlying the uncoupling layer. The entangled filament sheet includes a resilient three-dimensional web of extruded polymer monofilaments, the polymer monofilaments being heat welded at junctions to form an open network of tangled monofilament.

In one embodiment, the uncoupling layer is a breathable fabric. The breathable fabric is a woven or nonwoven polymeric fabric.

In another embodiment, the uncoupling layer comprises a waterproof membrane.

The uncoupling mat may further include a removable release liner adhered to the subfloor-bonding surface of the adhesive layer.

The adhesive layer of the uncoupling mat may be an asphalt containing adhesive. Alternatively, the adhesive layer of the uncoupling mat is asphalt free.

The monofilaments of the entangled filament sheet may be made of a polyolefin, polyamide, polyester, polyvinylhalide, polyvinylidene chloride, polyvinyltetrafluoride, polyvinyl chlorotrifluoride), polystyrene, polyvinylester or a mixture of two or more thereof.

In one embodiment, the monofilaments have an average diameter in the range of from about 1 mil to about 4 mils.

The uncoupling mat may further include a sound dampening layer.

The uncoupling mat may further include a radiant heat layer.

In another aspect of the invention there is provided a floor assembly that includes a sub-flooring layer; a top-flooring layer overlying the sub-flooring layer; and an uncoupling mat positioned between the sub-flooring layer and the top-flooring layer. The uncoupling mat includes an uncoupling layer; a layer of adhesive underlying the uncoupling layer, the adhesive layer having a subfloor-bonding surface; and an entangled filament sheet overlying the uncoupling layer, wherein the entangled filament sheet includes a resilient three-dimensional web of extruded polymer monofilaments, the polymer monofilaments being heat welded at junctions to form an open network of tangled monofilament.

In one embodiment, the top-flooring layer of the flooring assembly may be ceramic or stone tiles.

In another aspect of the invention there is provided a method of installing a flooring system that includes: providing a substrate; adhering an uncoupling mat to the substrate; depositing a mortar over the uncoupling mat to at least partially fill the plurality of open spaces of the entangled filament sheet; and providing a top-flooring layer over the mortar, wherein the uncoupling mat includes an uncoupling layer; a layer of adhesive underlying the uncoupling layer, the adhesive layer having a subfloor-bonding surface; and an entangled filament sheet overlying the uncoupling layer, the entangled filament sheet including a resilient three-dimensional web of extruded polymer monofilaments, the polymer monofilaments being heat welded at junctions to form an open network of tangled monofilament and a plurality of open spaces.

DETAILED DESCRIPTION

The present invention is directed to a self-adhesive uncoupling mat that reduces crack transmission in flooring installations, particularly for laying ceramic or stone floor coverings over a substrate. When tiles are installed over a substrate, the substrate will expand and contract at a different rate than the overlying tiles. This puts stress on the tile installation and can lead to cracking. The uncoupling mat lets the tile move independently from the substrate.

The uncoupling mat may provide an asphalt or asphalt free self-adhering membrane that bonds to either wood or concrete for reducing crack transmission.

As used herein, the terms "overlies" and "overlying", when referring to the relationship of one or a first layer relative to another or a second layer, refers to the fact that the first layer partially or completely lies over the second layer. The first layer overlying the second layer may or may not be in contact with the second layer. For example, one or more additional layers may be positioned between the first layer and the second layer. Similarly, the term "underlying", when referring to the relationship of one or a first layer relative to another or a second layer, refers to the fact that the first layer partially or completely lies under the second layer. The first layer underlying the second layer may or may not be in contact with the second layer.

Figure 1:
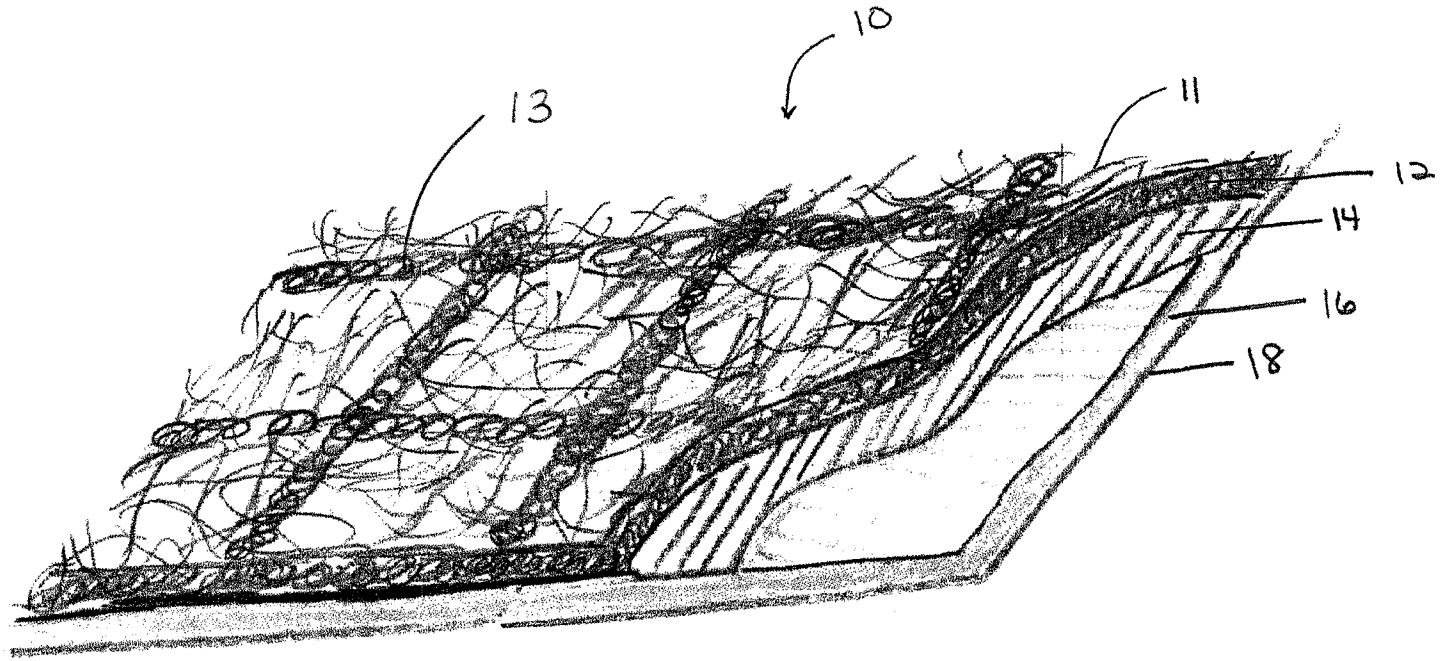
FIG. 1 is a perspective view of an uncoupling mat in accordance with the present invention.

Referring to FIG. 1, in one embodiment, the uncoupling mat 10 has multiple layers. Starting from the top surface 11, the mat includes an entangled filament sheet 12, an uncoupling layer 14 underlying the entangled filament sheet 12, and an adhesive layer 16 underlying the uncoupling layer 14. A removable release liner 18 may be adhered to the underside of adhesive layer 16.

The release liner 18 may be made from plastic or coated paper. Preferably, the release liner 18 includes a slit across the center area to facilitate installation. This allows for removal of a first section of the release liner so that a first portion of the membrane can be adhered to the subfloor while leaving the second portion with release paper still adhered. Then, the second section of the release paper may be removed to adhere the second portion of the mat to the subfloor.

The adhesive layer 16 may have a thickness in the range of 0.01 inch (0.25 mm) to 0.125 inch (3.18 mm). The adhesive layer may include a release strip on both sides that allows for better seaming to adjacent strips. The adhesive layer may have a selvedge edge of plastic sheeting that allows for better seaming.

Uncoupling layer 14 may be made from a polymeric material, such as a woven or non-woven fabric. In one embodiment, the uncoupling layer creates a bonding surface that is breathable and helps mortar dry more quickly. The uncoupling layer may be attached to the adhesive layer during the manufacturing process of the adhesive layer so that the uncoupling layer becomes a unitary structure with the adhesive layer. The uncoupling layer may be constructed from a range of polymers such as olefins, polyamides, polyesters, polypropylenes, polyethylene, PVC or natural fiber such as cotton, wool rayon. The fabric sheet may be of a type of woven such as slit film, point bonded, spun bonded, carded, needle punched, knit, or laid scrim.

In one embodiment, the uncoupling layer 14 is constructed of a waterproof membrane. As used herein, the term "waterproof" means that the membrane prevents moisture from being transmitted through the membrane.

The entangled filament sheet 12 creates an anchoring layer or reinforced mortar bed for mortar applied to its top surface. The entangled filament sheet 12 includes a plurality of intertwined filaments that twist and turn about at random and are bonded at random into sections or contact zones as by heat bonding or other suitable bonding or connection technique. Between the randomly entangled filaments are open space. The filaments may be of any suitable strong and mildew-resistant polymeric material.

The entangled filament sheet 12 may be constructed in accordance with techniques well known to one of ordinary skill in the art, such as disclosed by, for example, U.S. Pat. Nos. 3,687,759; 3,691,004; and 4,212,692, the contents of all of which are hereby incorporated by reference in their entireties.

The filaments of sheet 12 may be made from any thermoplastic polymer that provides the desired properties of strength and resilience for the application in which it is used. For example, the filaments may be made of a polyolefin (e.g., polyethylene, polypropylene, etc.), polyamide (e.g., Nylon), polyester, polyvinylhalide (e.g., polyvinylchloride (PVC), polyvinylidene chloride, polyvinyltetrafluoride, polyvinyl chlorotrifluoride), polystyrene, polyvinylester (e.g., polyvinyl acetate, etc.) or a mixture of two or more thereof. In one embodiment, the filaments have an average diameter in the range of from about 1 mils (0.025 mm) to about 4 mils (0.102 mm), and in one embodiment, from about 2 mils (0.051 mm) to about 3 mils (0.762 mm).

The entangled filament sheet may include a contoured surface, having a structural elements 13. In one embodiment, the structural elements for a grid-like pattern of projecting ribs. The projecting ribs may be formed in the entangled filament sheet when the thermoplastic filaments are extruded to form the filament sheet.

In one embodiment, the thickness of the filament sheet is between 0.05 inch (0.127 mm) and 0.30 inch (0.762 mm). Preferably, the thickness is in the range of 0.1 inch (0.254 mm) and 0.13 inch (0.330 mm).

Figure 2:
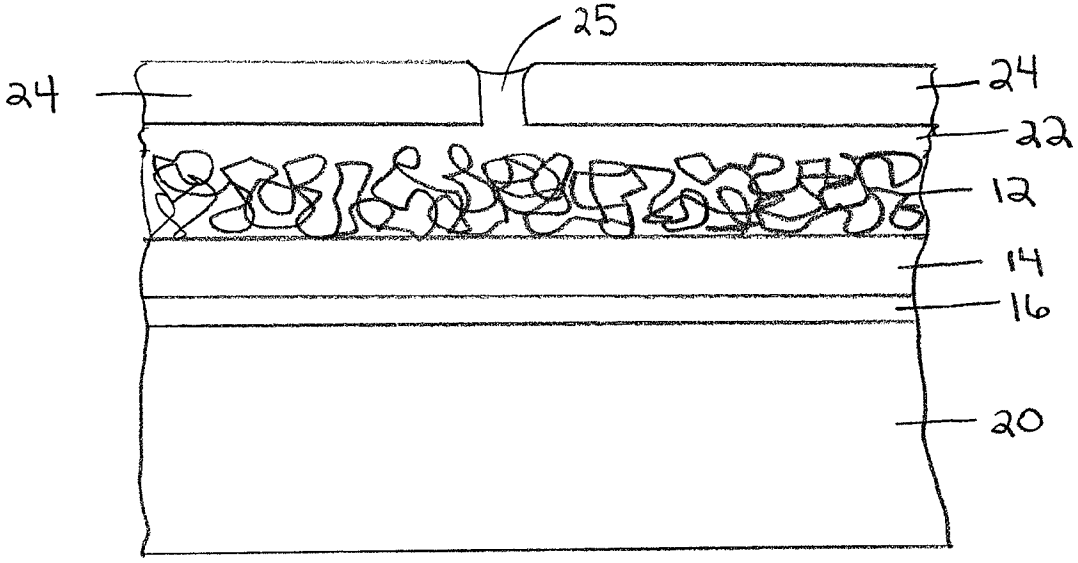
FIG. 2 is a cross sectional view through a floor assembly showing the uncoupling mat of FIG. 1 in the installed state.

Referring to FIG. 2, the uncoupling mat is shown installed on subfloor 20. Adhesive layer 16 adheres the uncoupling mat to the subfloor 20. Subfloor 20 may be any substrate, such as wood or concrete. Mortar 22 bonds tiles 24 to the entangled filament sheet 12 of the uncoupling mat. The tiles may be made of any durable material, such as for example ceramic or stone. The joints 25 between tiles 24 are filled with mortar. Mortar at least partially fills the open spaces of the entangled filament sheet to anchor the tiles and reinforce the flooring installation.

Figure 3:
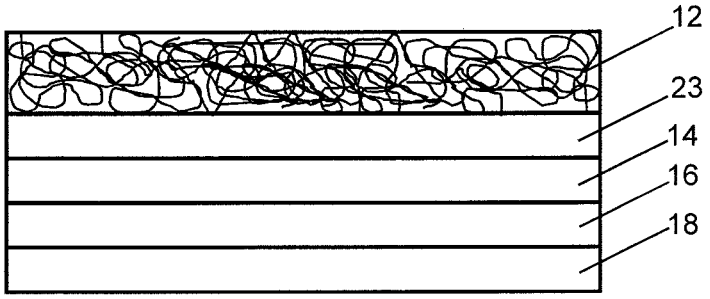
FIG. 3 is a cross sectional view of an embodiment of an uncoupling mat that includes a sound dampening layer in accordance with the present invention.

Referring to FIG. 3, in one embodiment, the uncoupling mat further includes a sound dampening layer 15. The sound dampening layer may be a compressible layer 15 underlying the uncoupling layer 14. The compressible layer may be manufactured from a polymeric material that is "cotton" like in nature.

In another embodiment, the uncoupling layer 14 acts as a sound dampening layer in addition to providing the uncoupling function.

Figure 4:
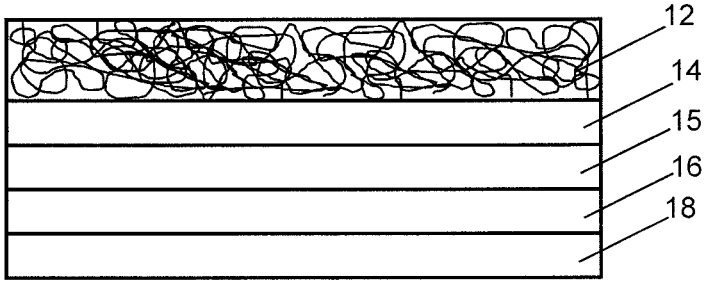
FIG. 4 is a cross sectional view of an embodiment of an uncoupling mat that includes a radiant heat layer in accordance with the present invention.

Referring to FIG. 4, the uncoupling mat further includes a radiant heat layer 23 interposed between the entangled filament sheet 12 and the uncoupling layer 14. The radiant heat layer 23 may include electric heating coils. The radiant heat layer 23 may be constructed of a heat conductive material, such as a metal film or a polymeric film containing heat conducting particles or filler.

In some cases, the subfloor has minor surface imperfections, such as divots or grooves, and those surface imperfections can be susceptible to moisture. The self-adhesive uncoupling mat can act to "self-heal" and assist in preventing the intrusion of moisture in areas such as a bathroom or kitchen, or other tiled areas, making the flooring less susceptible to moisture.

The installation of the uncoupling mat on plywood or concrete may, in some instances, require a priming agent. The mat may be provided in roll form that can be installed so that one half of the roll has the release paper removed. The exposed area would be bonded to the floor after application of a primer, if necessary. The release paper from the second half of the mat roll would be removed and the area would be bonded to the floor, eliminating creases by rolling and assuring no air was trapped under the mat. A selvedge edge may be included on the mat to provide a method of bonding two adjacent pieces. Eliminating air may involve rolling with a heavy roller.

Mortar is applied next into the uncoupling mat to fill in the voids in the geometric sheet or the entangled net. The mortar then is applied on top in a typical method of installing tile. A notched trowel creates a rectangular notch and tile is set directly into it.

The uncoupling mat with a breathable fabric on the bottom provides less impact noise through the subfloor in stacked, multi-family construction or in stacked single family construction.

While the invention has been explained in relation to various embodiments, it is to be understood that various modifications thereof will become apparent to those skilled in the art upon reading this specification. Therefore, it is to be understood that the invention provided herein is intended to cover such modifications as may fall within the scope of the appended claims.

The invention claimed is:

1. A self-adhesive uncoupling mat comprising:

an uncoupling layer;

a layer of adhesive underlying the uncoupling layer, the adhesive layer having a subfloor-bonding surface for self-adhering the self-adhesive uncoupling mat to a subfloor; and an entangled filament sheet overlying and contacting the uncoupling layer, the entangled filament sheet comprising a resilient three-dimensional web of extruded polymer monofilaments, the polymer monofilaments being heat welded at junctions to form an open network of tangled monofilament, wherein the resilient three-dimensional web comprises a grid-like pattern of projecting ribs formed of the extruded polymer monofilaments.

2. The uncoupling mat of claim 1, wherein the uncoupling layer comprises a breathable fabric.

3. The uncoupling mat of claim 2, wherein the breathable fabric comprises a woven or nonwoven polymeric fabric.

4. The uncoupling mat of claim 1, wherein the uncoupling layer comprises a waterproof membrane.

5. The uncoupling mat of claim 1, further comprising a removable release liner adhered to the subfloor-bonding surface of the adhesive layer.

6. The uncoupling mat of claim 1, wherein the adhesive layer comprises an asphalt containing adhesive.

7. The uncoupling mat of claim 1, wherein the adhesive layer is asphalt free.

8. The uncoupling mat of claim 1, wherein the monofilaments may be made of a polyolefin, polyamide, polyester, polyvinylhalide, polyvinylidene chloride, polyvinyltetrafluoride, polyvinyl chlorotrifluoride), polystyrene, polyvinylester or a mixture of two or more thereof.

9. The uncoupling mat of claim 8 wherein the monofilaments have an average diameter in the range of from about 1 mil to about 4 mils.

10. The uncoupling mat of claim 1, further comprising a sound dampening layer.

11. The uncoupling mat of claim 1, further comprising a radiant heat layer.

12. A floor assembly, comprising:

a sub-flooring layer;

a top-flooring layer overlying the sub-flooring layer; and a self-adhesive uncoupling mat positioned between the sub-flooring layer and the top-flooring layer, the uncoupling mat comprising:

an uncoupling layer;

a layer of adhesive underlying the uncoupling layer, the adhesive layer having a subfloor-bonding surface for self-adhering the self-adhesive uncoupling mat to the sub-flooring layer; and an entangled filament sheet overlying and contacting the uncoupling layer, the entangled filament sheet comprising a resilient three-dimensional web of extruded polymer monofilaments, the polymer monofilaments being heat welded at junctions to form an open network of tangled monofilament, wherein the resilient three-dimensional web comprises a grid-like pattern of projecting ribs formed of the extruded polymer monofilaments.

13. The floor assembly of claim 12, wherein the top-flooring layer comprises ceramic or stone tiles.

14. A method of installing a flooring system comprising:

providing a substrate;

adhering a self-adhesive uncoupling mat to the substrate, the uncoupling mat comprising:

an uncoupling layer;

a layer of adhesive underlying the uncoupling layer, the adhesive layer having a subfloor-bonding surface for self-adhering the self-adhesive uncoupling mat to the substrate; and an entangled filament sheet overlying and contacting the uncoupling layer, the entangled filament sheet comprising a resilient three-dimensional web of extruded polymer monofilaments, the polymer monofilaments being heat welded at junctions to form an open network of tangled monofilament and a plurality of open spaces, wherein the resilient three-dimensional web comprises a grid-like pattern of projecting ribs formed of the extruded polymer monofilaments;

depositing a mortar over the uncoupling mat to at least partially fill the plurality of open spaces of the entangled filament sheet; and providing a top-flooring layer over the mortar.

* * * * *